US005472280A

United States Patent [19]

Rittmaster

[11] Patent Number: 5,472,280

[45] Date of Patent: Dec. 5, 1995

[54] BAG STORABLE IN CLOSURE POUCH

[75] Inventor: Peter A. Rittmaster, Readfield, Me.

[73] Assignee: Lasker Harris, Hewlett, N.Y.

[21] Appl. No.: 210,256

[22] Filed: Mar. 18, 1994

Related U.S. Application Data

[63] Continuation-in-part of Ser. No. 972,052, Nov. 5, 1992, abandoned, which is a continuation of Ser. No. 756,077, Sep. 6, 1991, abandoned.

[51] Int. Cl.[6] ..... B65D 30/06; B65D 30/22; B65D 33/06; B65D 33/24

[52] U.S. Cl. ..... 383/6; 150/108; 383/4; 383/37; 383/86; 383/117; 383/127

[58] Field of Search ..... 383/4, 127, 118, 383/117, 86, 37, 6; 150/114, 108; 190/108

[56] References Cited

U.S. PATENT DOCUMENTS

| | | | |
|---|---|---|---|
| 1,361,761 | 12/1920 | Gay | 150/108 |
| 1,553,697 | 9/1925 | Lederer | 383/2 |
| 1,604,658 | 10/1926 | Post | 383/2 |
| 1,606,107 | 11/1926 | Simms | 383/2 |
| 1,666,704 | 4/1928 | Hunter | 383/2 |
| 1,810,813 | 6/1931 | Bertini | 383/117 |
| 2,493,085 | 1/1950 | Pincus | 383/2 |
| 2,682,290 | 6/1954 | Ditlea | 383/2 |
| 2,871,900 | 2/1959 | Auditore | 383/2 |
| 3,082,713 | 3/1963 | Elgin | 383/86 |
| 3,322,176 | 5/1967 | Geller | 383/2 |
| 3,557,853 | 1/1971 | Jones | 383/86 |
| 3,587,698 | 6/1971 | Ritter | 383/2 |
| 3,874,435 | 4/1975 | Allen | 383/86 |
| 3,989,080 | 11/1976 | Koszegi | 383/2 |
| 4,047,550 | 9/1977 | Scholz | 383/118 |
| 4,117,874 | 10/1978 | Berenguer | 383/2 |

FOREIGN PATENT DOCUMENTS

| | | | |
|---|---|---|---|
| 929808 | 1/1948 | France | 383/2 |
| 993004 | 10/1951 | France | 383/117 |
| 681522 | 10/1952 | United Kingdom | 383/2 |

*Primary Examiner*—Stephen P. Garbe
*Attorney, Agent, or Firm*—Anderson Kill Olick & Oshinsky

[57] ABSTRACT

A carrying bag which is foldable into a compact configuration so that it can be stored in a pouch, wherein an upper edge of a pouch wall is attached to the bag at an edge defining the bag opening and wherein the pouch includes a flap which can be used to close the pouch when the bag is inside and to close the bag when the bag is in its unfolded condition.

6 Claims, 7 Drawing Sheets

BAG STORABLE IN CLOSURE POUCH

This is a continuation-in-part of application Ser. No. 07/972,052 filed Nov. 5, 1992, now abandoned which is a continuation of application Ser. No. 07/756,077, filed Sep. 6, 1991 (abandoned).

FIELD OF THE INVENTION

The present invention relates to a bag storable within a pouch and more particularly to a pouch secured to the bag, wherein the pouch also serves as a means for closing the bag.

BACKGROUND OF THE INVENTION

Bags for storing or carrying various materials and objects are, of course, well known. Such bags come in scores of sizes and shapes and today, are constructed of ever stronger fabrics or synthetics as materials technology continues to improve. Typical of the stronger materials which may be used to construct bags today, include rayon, nylon, polyester and various synthetics.

Shopping bags are typically designed to transport loads which the average person may comfortably carry. These bags, however, are ungainly when they are carried, but are not in use. On such occasions, the bags may be folded or otherwise compacted, although they do not remain so. Consequently the bags are tied in the folded position by various attachment means such as rubber bands, ropes, or the like. Such attachment means are, unfortunately, easily forgotten, lost, destroyed or otherwise separated from the bag. It is thus desirable to have a bag with folding or compacting means which remain secured to the bag.

Bags typically having such folding or compacting means are shown in U.S. Pat. Nos. 2,493,085 (Pincus), 3,322,176 (Geller), 3,587,698 (Ritter), 4,085,873 (Schweitzer), 4,117,874 (Berenguer), 4,782,874 (Chartier) and 5,009,516 (Geeck). Each of these patents discloses relatively large bags which may be folded into a smaller pouch. One transporting the bag would simply carry the smaller, compact pouch, which contains the larger bag. Unfortunately however, such bags have certain disadvantages. None of these patents discloses or suggests, (for instance, a bag storable in a closure pouch, wherein the pouch, when the bag is in use, is usable as a purse), a means for closing the bag and serves also as an advertising or message medium which is readily visible to bystanders.

The Pincus patent discloses, for example, a pouch which forms the bottom of a bag when the bag is used. The pouch does not appear to be useable as a separate purse when the bag is in use because one would have to reach through the contents of the bag to reach the pouch. The pouch is also not useable as an advertising or message medium since it rests on the bottom of the bag (see Pincus FIG. 1) so that its planar faces are not in the view of bystanders. The Pincus patent moreover fails to disclose a pouch which serves also as a bag closing means when the bag is being used.

The Geller patent bag, like the Pincus patent bag, also embodies a pouch which forms the bottom of the bag when the bag is used. This pouch is also not useable as a separate purse when the bag is in the open or the "in use" position not only because it is positioned on the bottom of the bag, but also because it is made of netting, through which change and other items would easily fall. The pouch's location, as well as the netting construction means that the pouch also could not readily serve as an advertising or message medium.

The Ritter patent reveals a bag and a pouch which is attached by a flap to the bag. The pouch does not however serve as a means for keeping the bag closed when the bag is being used. Indeed, the Ritter bag teaches away from such use and employs simply a traditional drawstring to close the bag. The same applies to the Schweitzer patent which depicts a backpack foldable into a pouch and uses a zipper to close the bag, which, in this case is the backpack.

The Berenguer patent describes a shopping bag foldable within a pouch. The intended function of the Berenguer pouch is to serve as a pouch compartment inside the bag. Like the bag shown in the other patents, the Berenguer pouch fails to serve as a means to close the bag when the bag is being used. Indeed the Berenguer bag does not teach any type of bag closing mechanism.

The Chartier patent, like the Pincus and Geller patents, also describes a pouch which accommodates a folded bag. The pouch rests upon and serves to strengthen the bottom of the bag when the bag is in use and cannot serve as an advertising or message medium for others to see when the bag is in use. Again, as with the other bags, the Chartier pouch does not serve as a means for closing the shopping bag when the bag is being used.

The Geeck patent also reveals a pouch which accommodates a folded bag. The pouch does not appear to be sufficiently large or to embody a sufficiently planar surface to facilitate its use as an advertising or message medium. Again, as with other bags, the Geeck patent bag does not serve as a means for closing the bag when the bag is in use.

As evidenced by the above patents, one skilled in the art did not contemplate use of a pouch as a closing mechanism and, in fact, felt compelled to use a different means, if any, to close the bag. Those skilled in the art were focussing more on improving the materials constituting the bag or the pouch, rather than directing their energies to the bag closing means.

It is therefore an object of the invention to provide a bag for storing and carrying objects.

Another object of the invention is to provide such a bag with a pouch which is usable simultaneously with the bag.

Yet another object of the invention is to provide a bag and pouch, wherein the pouch serves also as a means for closing the bag when the bag is in use.

A further object of the invention is to provide a bag and an attached pouch, wherein the pouch serves also as an advertising or message medium which is readily visible to bystanders.

SUMMARY OF THE INVENTION

These and other objects of the invention are achieved by a bag storable in a closure pouch, comprising generally a relatively large bag constructed from preferably a strong cotton, rayon or similar material and a cotton pouch having two planar faces and a flap. The pouch is attached to the outside of the bag at the bag's upper end, is usable when the bag is also in use, serves as a bag closing mechanism and as a medium on which advertisements or other messages are readily visible to others. The bag also embodies two long, looped handles which facilitates over-the-shoulder or hand conveyance (e.g. around the wrist) of either the bag or of the pouch having the bag folded therein. The pouch may be worn around the neck or on a belt or even inserted into one's pockets.

The invention will be better understood with respect to the detailed description of the preferred embodiment in conjunction with the following drawings of which:

DETAILED DESCRIPTION OF THE PREFERRED EMBODIMENT

Figure 1:
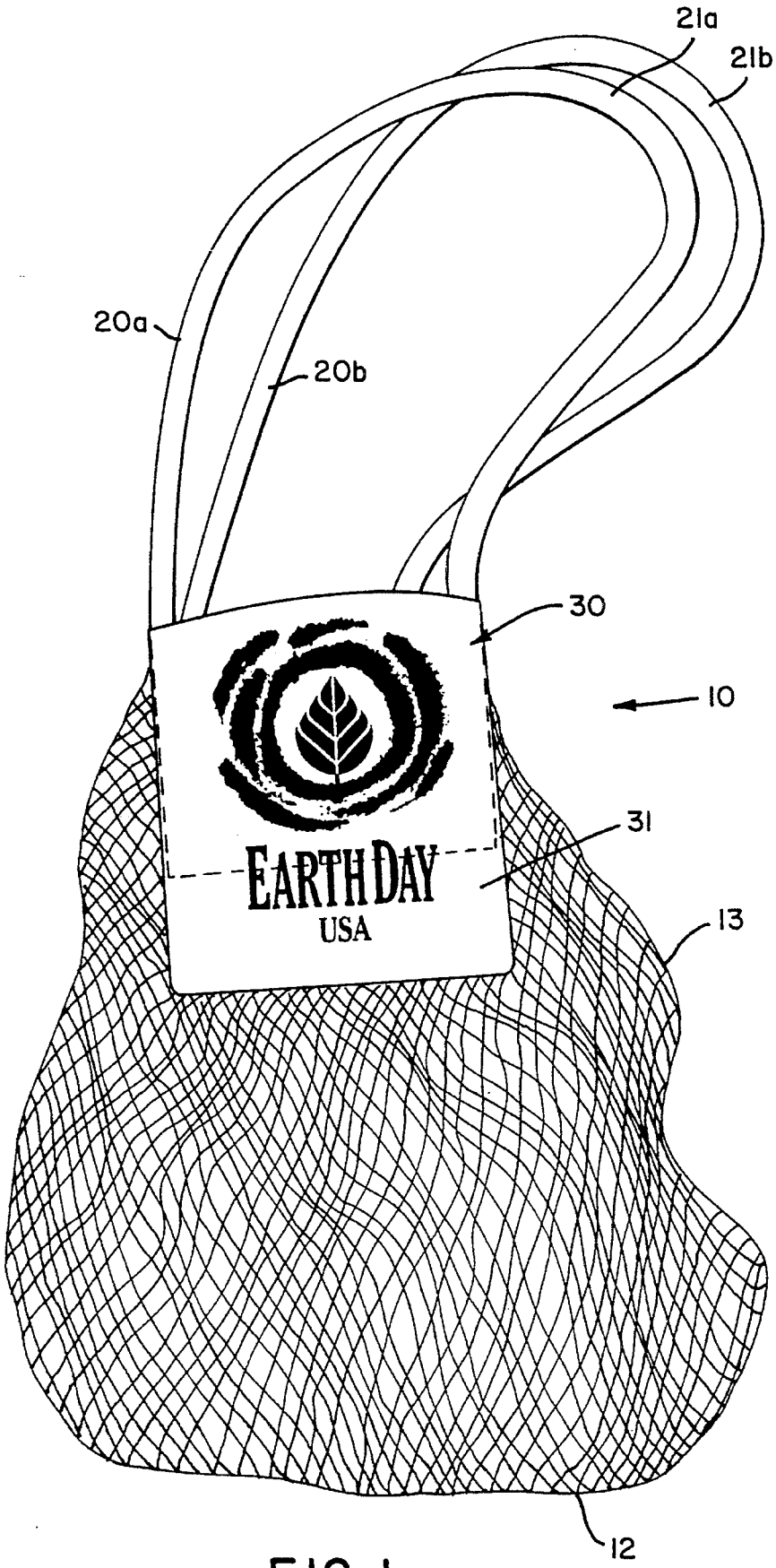
FIG. 1 is a side view of the bag storable in a closure pouch.

Reviewing now the drawings wherein like numerals represent like elements throughout the several views, FIG. 1 is a side view of the bag storable in a closure pouch, comprising generally bag 10, handles 20*a*, 20*b* and pouch 30. Bag 10 is relatively large in comparison to pouch 30 and has an open top 11 (see FIG. 2), a closed bottom 12 and comprises netting strands 13 which are interwoven in a criss-cross pattern. The strands 13 are constructed of a strong and relatively elastic material, preferably cotton or rayon which are also ecologically preferred over plastic and paper bags, although the latter types of bags may also be used. Bag 10 holds and stretches to accommodate its contents.

Figure 2:
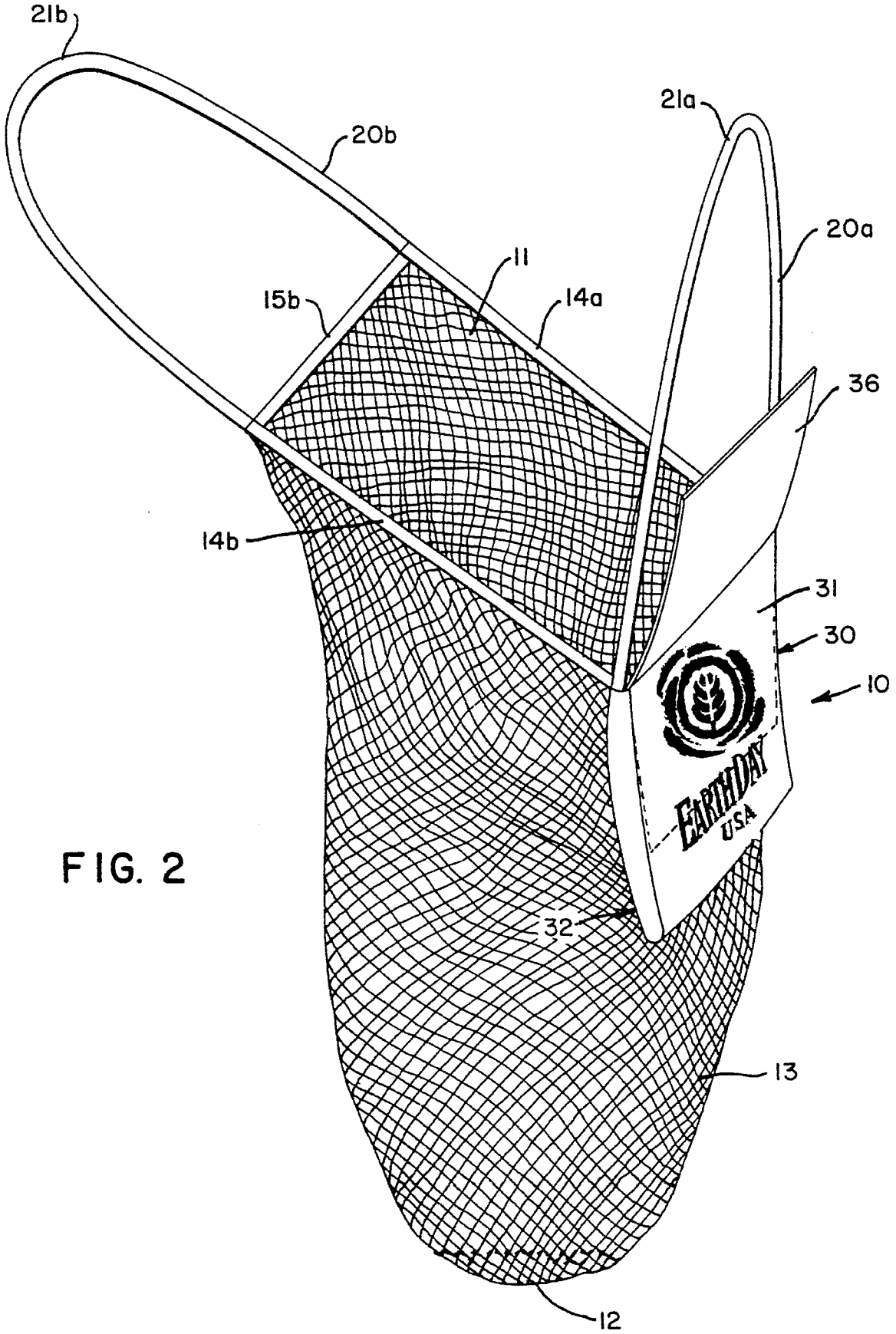
FIG. 2 is an open perspective view of the bag storable in a closure pouch.

The top 11 of the bag 10, as best seen in FIG. 2, has a pair of parallel selvages 14*a*, 14*b* and short bridges 15*a* (see FIG. 6), 15*b* (see FIG. 2) constructed of thicker, woven cloth material. The selvages 14*a*, 14*b* are located between the two bridges 15*a*, 15*b* which are also parallel to each other and which are perpendicular to the selvages 14*a*, 14*b*, creating a roughly rectangular opening into which the contents to be carried or stored are placed into the bag 10.

Large looped handles 20*a*, 20*b* (see FIGS. 1–3, 5, 6), are secured to the top 11 of the bag in such manner that the arcs 21*a*, 21*b* of each handle 20*a*, 20*b* are parallel to the respective bridges 15*a*, 15*b*. The handles 20*a*, 20*b* may be shortened to fit the physical characteristics of the person carrying the bag 10 and its contents or the person carrying pouch 30 containing the folded bag 10 by simply holding together the two handles and making a knot. Of course, other adjustable means, such as buckles, may be implemented to adjust the length of the handles 20*a*, 20*b*.

Pouch 30 is secured to the outside of the bag 10 at the bridge 15*a* (see FIG. 6) at top 11 and is typically made from a cotton material, although canvas, rayon or other suitable materials may be used. The pouch 30 comprises two planar walls 31, 32 (see FIGS. 3–6), with a fold 33 between them at their lower intersection and sides 34, 35 which are sewn together. The pouch 30 has a flap 36 which extends from wall 31, which is the wall of the pouch 30 furthest (see FIG. 5) from the bag 10.

Figure 6:
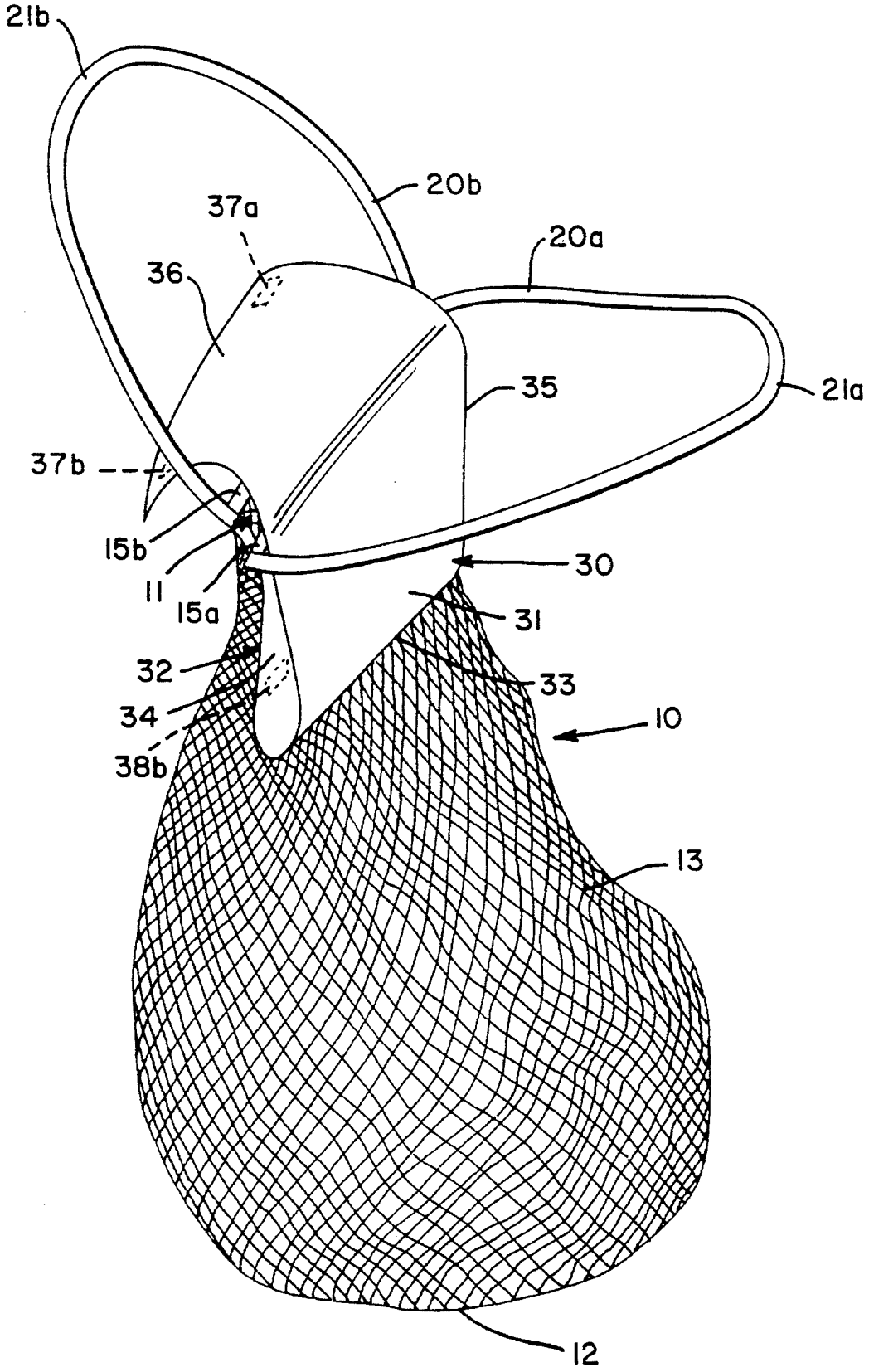
FIG. 6 is a perspective view of the bag storable in a closure pouch, depicting the flap of the pouch pulled through the handles and about to close the bag.

The flap 36 closes the pouch 30 when it is being used as a purse, in conjunction with the bag 10, or when the bag 10 is folded within the pouch 30. As shown in FIG. 6, the pouch 30 closes the bag by crossing flap 36 over bridges 15*a*, 15*b* and mating (i.e., by pressing with the finger) a securing means, preferably comprising VELCRO™ strips 37*a*, 37*b* on flap 36 to corresponding VELCRO™ strips 38*a*, 38*b* (see FIGS. 5, 7) on wall 32 of the pouch 30.

Figure 7:
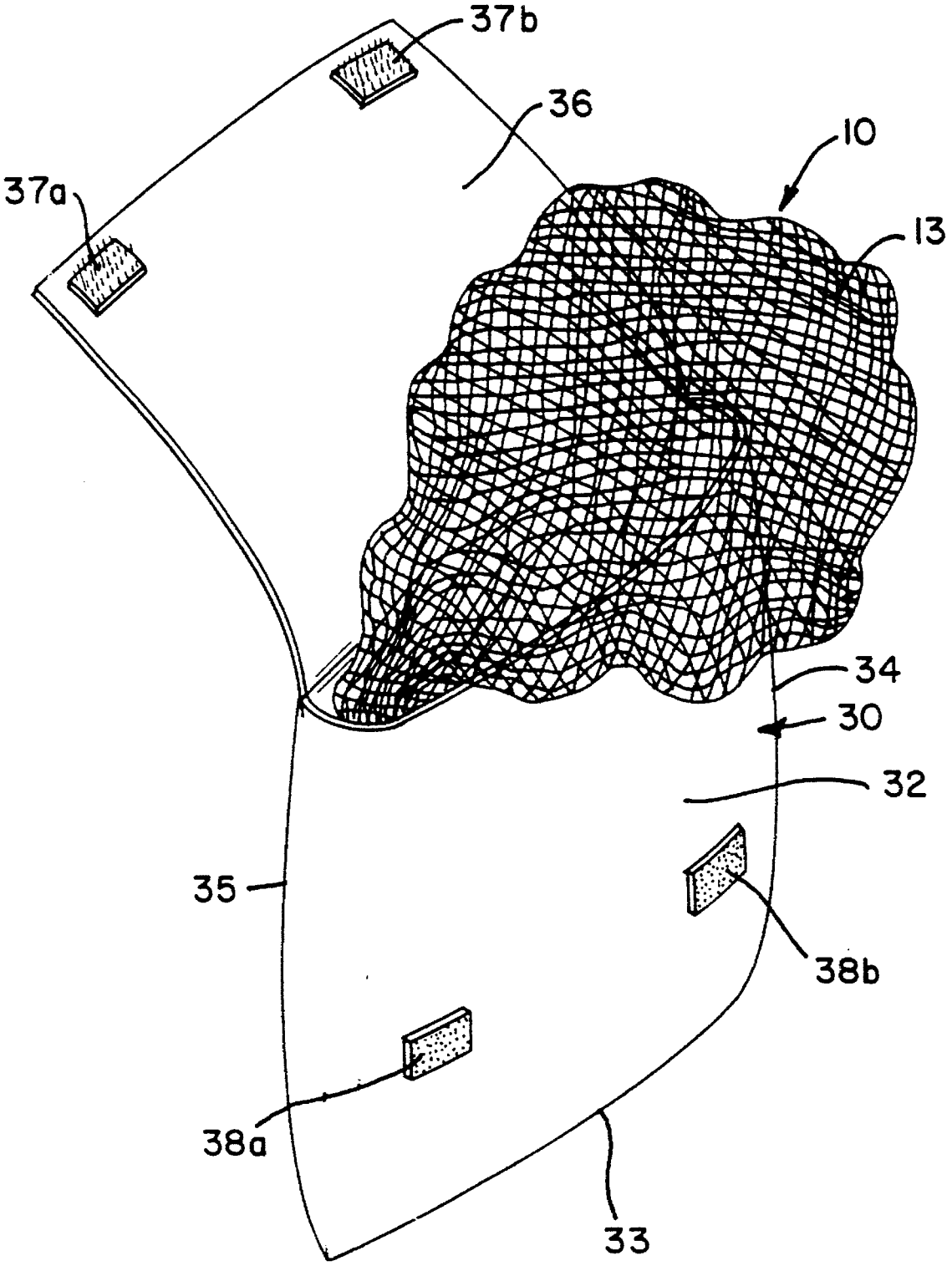
FIG. 7 is a perspective view of the bag storable in a closure pouch, wherein the bag is being folded into the pouch.
Figure 8:
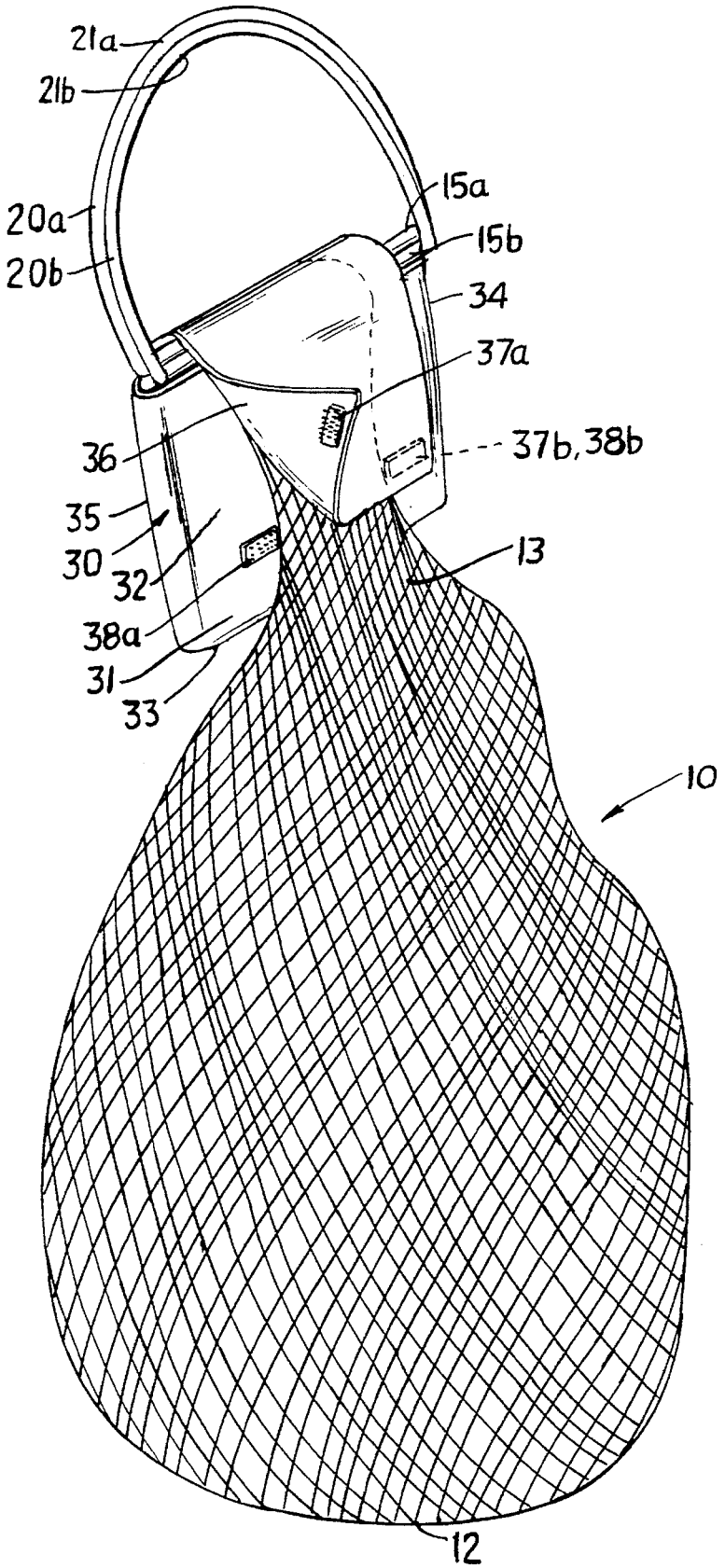
FIG. 8 is a perspective view of the bag closed by the pouch.

The netting strands 13 of bag 10 may be moved out of the way with one's fingers, by being squeezed toward each other in a direction substantially parallel to a longitudinal extent of the short bridges 15*a*, 15*b*, if necessary. Thereby, the strands 13 do not obstruct the space between the VELCRO™ strips 37*a*, 38*a* and 37*b*, 38*b* which, thus, become exposed to each other. The pouch closes upon engagement of the strips 37*a*, 37*b* and 38*a*, 38*b*, respectively. The bag 10 is closed when the strips 37*a*–38*a*, 37*b*–38*b* are brought together, securing the contents within it. The bag 10 may be folded into the pouch 30 as shown in FIG. 7. The pouch 30 is then secured by mating the corresponding VELCRO™ strips 37*a*–38*a*, 37*b*–38*b*. The VELCRO™ strips or other means may be used at various locations in the invention and may also affect the location of the pouch relative to the bag (e.g., inside or outside of bag). The pouch 30, enclosing the bag may be worn around the neck (see FIG. 5), over the shoulder or in a backpack-like manner by pulling one arm of the wearer through each loop. The pouch 30, may also be worn on the wearer's belt 40 (see FIG. 4) by threading the belt 40 between the flap 36 and wall 32 when the strips 37*a*–38*a*, 37*b*–38*b* are mated or by merely tying the handles to the belt.

Figure 3:
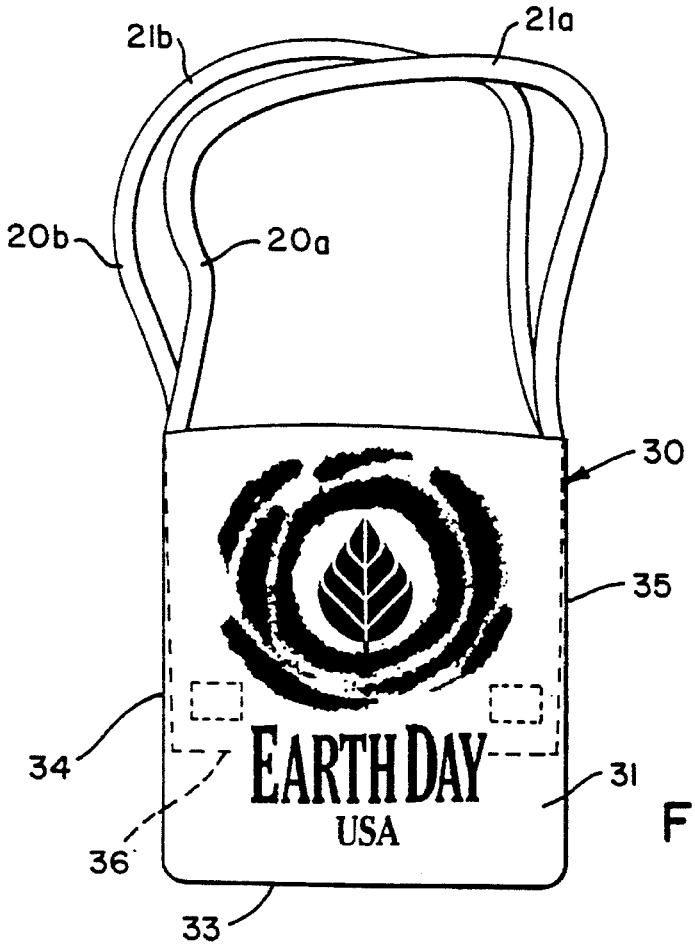
FIG. 3 is a side view of one side of the pouch of the invention with the bag stored in the closure pouch.
Figure 4:
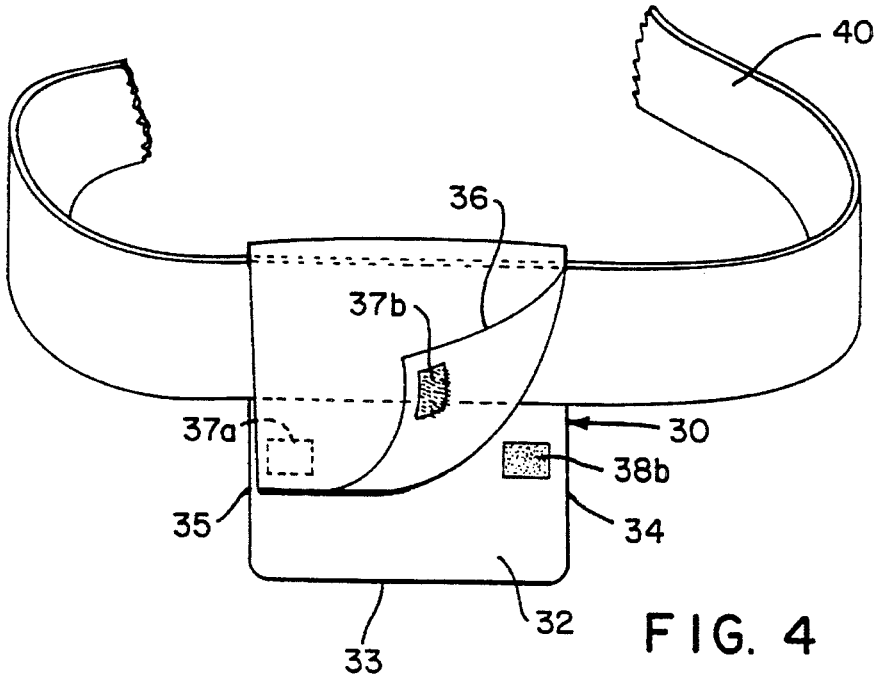
FIG. 4 is a side view of the other side of the pouch of the bag storable in a closure pouch.
Figure 5:
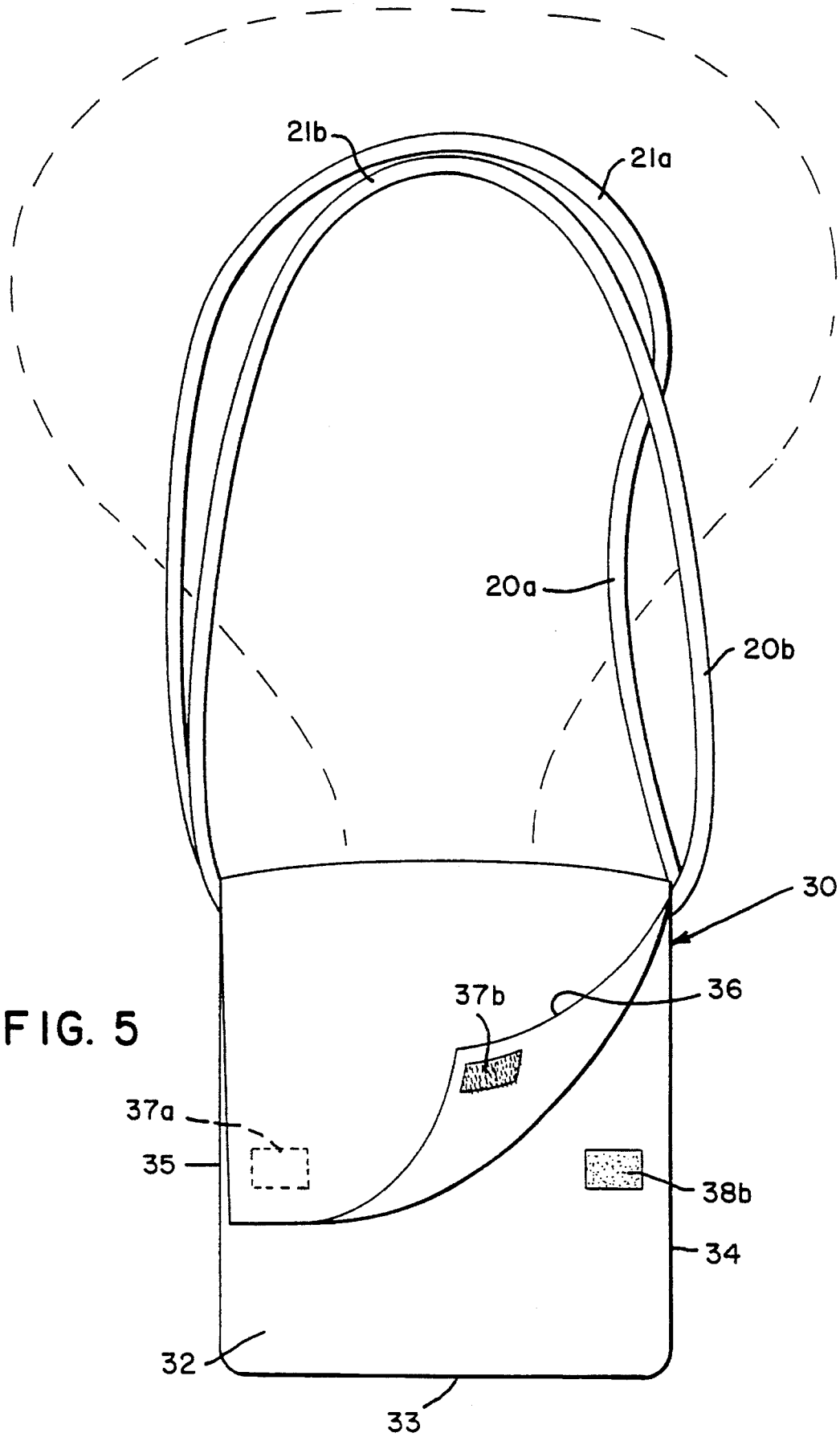
FIG. 5 is also a side view of the other side of the pouch of the bag storable in a closure pouch with the handles out of the pouch.

The flap 36 and planar walls 31, 32 of pouch 30 may be used as an advertising or message medium, as shown particularly in FIGS. 1 and 3, whether or not the pouch is being used as a purse while the bag also is in use, or simply to carry the bag 10.

Although a generic "shopping" type of bag has been disclosed, the bag 10 may be used, modified or replaced to serve as a gym bag, laundry bag, book bag, etc. . . and still fall within the contemplated invention.

While the preferred embodiment of the invention has been described in detail, it is to be expressly understood that adaptation and modifications may be made thereof without departing from the spirit and scope of the invention, as defined in the following claims:

I claim:

1. A bag assembly for storing and carrying goods, comprising:

a carrying bag made of foldable materials and having an opening;

a pouch attached to said carrying bag for storing said bag in a folded condition thereof and having dimensions which are substantially smaller than the dimension of said carrying bag in an unfolded carrying condition thereof;

wherein said pouch comprises a front wall, a rear wall and means for connecting side and bottom edges of said front and rear wall to each other; and wherein said rear wall includes, at an upper edge thereof, means for attaching said pouch at an edge of said carrying bag defining said bag opening, and said front wall includes a flap pivotally attached to an upper edge thereof;

a means for detachably attaching said flap to said rear wall of said pouch, wherein said detachably attaching means serves to close said pouch when said bag is folded within said pouch;

wherein said flap attaching means comprises two laterally spaced fasteners each having a first fastening member secured adjacent to a respective one of lateral sides of said rear wall and a second fastening member secured to said flap for engaging said first member; and wherein said rear wall and said flap have a width such that said flap closes said bag opening and said pouch in the unfolded condition of said carrying bag, with a portion of said bag adjacent said bag opening being compressed between said rear wall and said flap in a space limited by said two fasteners in a closed position of said two fasteners.

2. The bag assembly of claim 1, wherein said carrying bag has adjustable loop handles secured to opposite edges of said bag defining partially said opening.

3. The bag assembly of claim 2, wherein said bag comprises two spaced selvages, and two spaced bridges connecting said selvages and defining therewith said opening, said opposite edges being formed by said bridges.

4. The bag assembly of claim 1, wherein said bag is made of netting strands.

5. The bag assembly of claim 4, wherein said strands are interwoven in a criss-cross pattern.

6. The bag assembly of claim 1, wherein said first and second fastening members are VELCRO™ strips.

* * * * *